US008834017B2

(12) United States Patent
Farron et al.

(10) Patent No.: US 8,834,017 B2
(45) Date of Patent: Sep. 16, 2014

(54) QUICK CORRECTOR FOR A TIME RELATED MAGNITUDE INDICATOR FOR A TIMEPIECE

(75) Inventors: Adrien Farron, Neuchatel (CH); Christian Rüfenacht, Bienne (CH)

(73) Assignee: Omega SA (CH)

( * ) Notice: Subject to any disclaimer, the term of this patent is extended or adjusted under 35 U.S.C. 154(b) by 426 days.

(21) Appl. No.: 13/298,007

(22) Filed: Nov. 16, 2011

(65) Prior Publication Data

US 2012/0182838 A1 Jul. 19, 2012

(30) Foreign Application Priority Data

Nov. 16, 2010 (EP) ..... 10191387

(51) Int. Cl.
*G04B 27/02* (2006.01)
*G04F 7/08* (2006.01)

(52) U.S. Cl.
CPC ..... *G04B 27/026* (2013.01); *G04F 7/0871* (2013.01); *G04F 7/0866* (2013.01); *G04F 7/0804* (2013.01); *G04F 7/0842* (2013.01)
USPC ..... 368/190; 368/18; 368/37

(58) Field of Classification Search
CPC ..... G04B 27/00; G04B 27/02
USPC ..... 368/18, 37, 190
See application file for complete search history.

(56) References Cited

U.S. PATENT DOCUMENTS

| | | | | |
|---|---|---|---|---|
| 508,467 | A | 11/1893 | Clark | |
| 4,766,579 | A * | 8/1988 | Sporring | 368/190 |
| 5,367,504 | A * | 11/1994 | Ferenczy | 368/15 |
| 6,570,823 | B1 * | 5/2003 | Gilomen et al. | 368/113 |
| 6,918,694 | B2 * | 7/2005 | Speichinger et al. | 368/190 |
| 7,441,945 | B2 * | 10/2008 | Laucella et al. | 368/190 |
| 7,445,374 | B2 * | 11/2008 | Forsey et al. | 368/101 |
| 7,980,756 | B2 * | 7/2011 | Graemiger et al. | 368/192 |
| 2008/0159081 | A1 | 7/2008 | Laucella et al. | |
| 2010/0097898 | A1 * | 4/2010 | Oppliger et al. | 368/106 |

FOREIGN PATENT DOCUMENTS

| | | |
|---|---|---|
| CH | 577197 B5 | 10/1975 |
| CH | 651172 A3 | 9/1985 |
| CH | 671317 B5 | 8/1989 |

(Continued)

OTHER PUBLICATIONS

European Search Report of EP 10 19 1387 dated May 23, 2011.

*Primary Examiner* — Amy Cohen Johnson
*Assistant Examiner* — Jason Collins
(74) *Attorney, Agent, or Firm* — Sughrue Mion, PLLC

(57) ABSTRACT

A corrector (1) for a function indicator (20) for a movement (100) including: a first control mechanism (30) for a first function, in a let down (31) or wound (32) position, a second control mechanism (40) for a second function, in a let down position (41) or release control position (42) followed by a return to the preceding position, and a display indicator (20) for a third function. First mobile part (50) driven by the first control mechanism (30) occupies a letting down (51)/winding (52) position, when the mechanism occupies the let down (31)/wound (32) position. Second mobile part (60) actuating the indicator (20) is driven by the second control mechanism (40) changing into the control position (42) when the first mobile part (50) is in a winding position (52) and cooperates with this latter in the letting down position (51), under the action of return mechanism (70).

17 Claims, 3 Drawing Sheets

(56) References Cited

FOREIGN PATENT DOCUMENTS

| | | | |
|---|---|---|---|
| CH | 672223 | A | 11/1989 |
| CH | 688171 | B5 | 6/1997 |
| CH | 698878 | B1 | 11/2009 |
| DE | 3024165 | A1 | 1/1982 |
| DE | 3137399 | A1 | 4/1983 |
| EP | 0107177 | B1 | 5/1984 |
| EP | 0230878 | B1 | 8/1987 |
| EP | 0479147 | A1 | 4/1992 |
| EP | 1939699 | A1 | 7/2008 |
| FR | 2862143 | A1 | 5/2005 |
| WO | 2005/103844 | A1 | 11/2005 |

* cited by examiner

Fig. 1
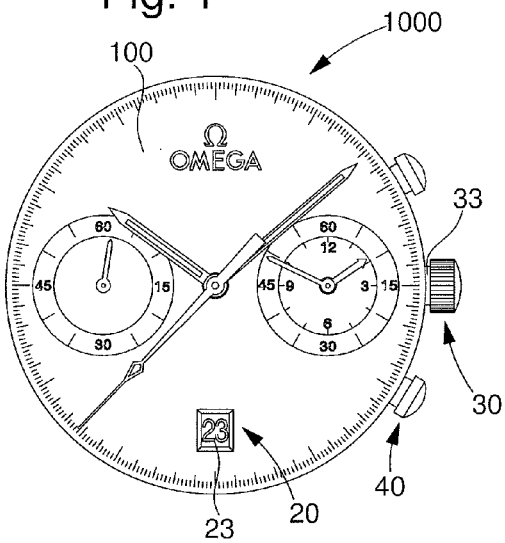
Fig. 2
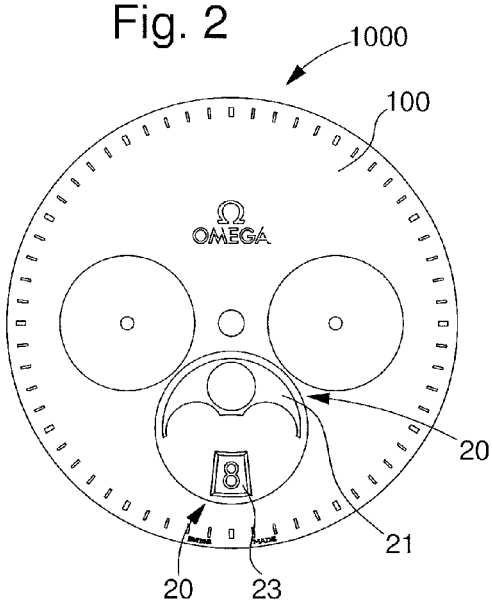
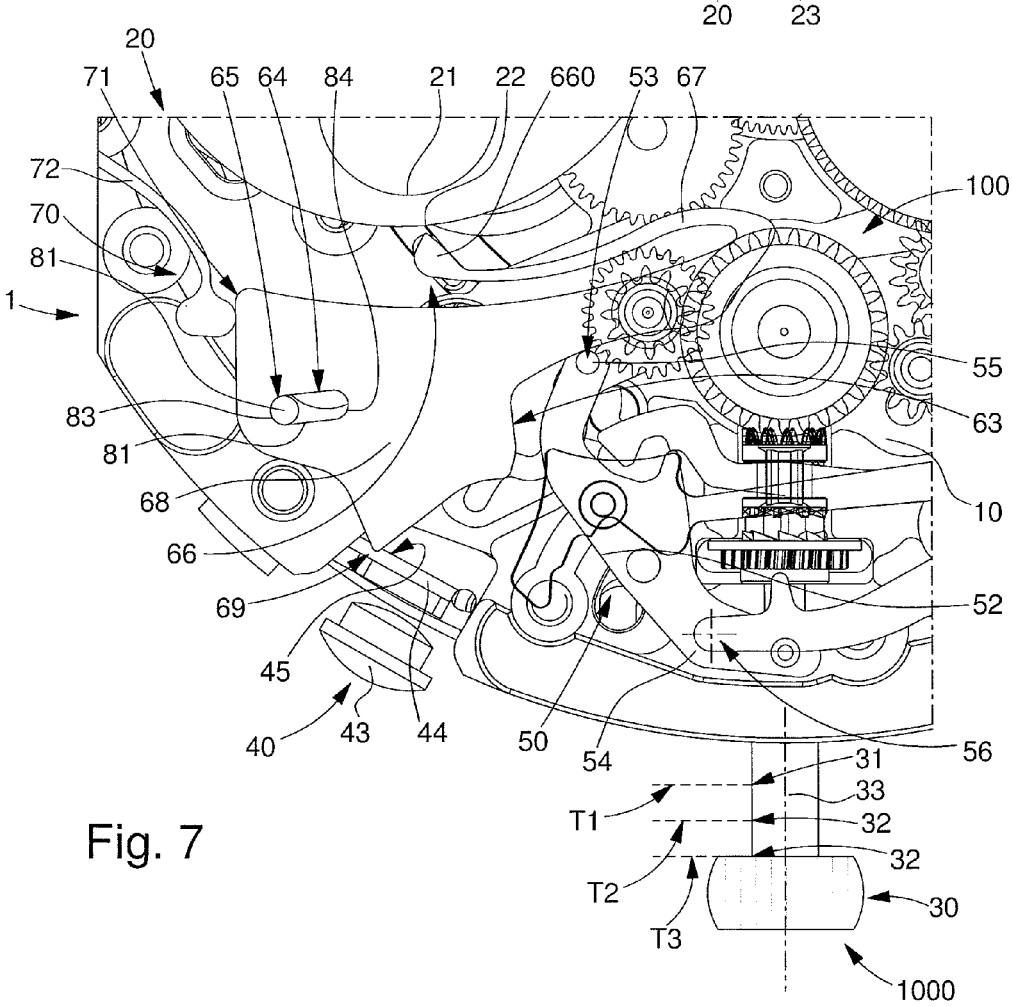
Fig. 7

QUICK CORRECTOR FOR A TIME RELATED MAGNITUDE INDICATOR FOR A TIMEPIECE

This application claims priority from European Patent Application No. 10191387.9 filed Nov. 16, 2010, the entire disclosure of which is incorporated herein by reference.

FIELD OF THE INVENTION

The invention concerns a quick corrector mechanism for a function display indicator for a movement or a timepiece, wherein said movement or said timepiece includes, directly or indirectly mounted on a plate:

First control means for at least a first function, connected to first display means and capable of occupying a let down position or at least one wound control position.

Second control means for a second function, distinct from said first function, connected to second display means and capable of changing, under the effect of an action by a user, from a let down rest position to a wound control position for the instantaneous release of said second function, wherein at the end of said instantaneous release, said second control means is returned to said let down rest position by return means.

Said second control means is distinct from said first control means.

Display means for a third function, different from said first and second functions, formed by said indicator, which has drive means for driving itself.

The invention also concerns a timepiece including at least one movement of this type, and/or one quick corrector mechanism of this type.

The invention concerns the field of horology, and more specifically the field of timepieces which include complications for displaying time related magnitude, such as the date, moon phase, day, month, or suchlike.

The invention concerns the field of chronographs provided with complications of this type.

BACKGROUND OF THE INVENTION

The display of time related magnitudes, such as the date, moon phase, tides, day and month, is generally achieved in mechanical timepieces by using wheel sets driven by the movement, most often by the hour wheel. Certain of these relative magnitudes require corrections by making up time, either, in the case of a date, to make up for leap years, or in the case of moon phases, to compensate for the slight difference between the lunar months and the approximation made thereof by the gear train. These corrections may also prove necessary if references are lost, for example after the timepiece suffers a shock.

Conventionally, this type of display includes a disc or a ring, respectively integral with a toothed wheel or a toothed crown, or suchlike, and the timepiece movement drives said wheel or said crown at a certain rate at the required frequency.

For a long time, displays of this type have been corrected by using an additional push button, which acts directly on the toothing, as in U.S. Pat. No. 508,467 in the name of CLARK, wherein this push button is formed by a bent spring, which abuts against one tooth of the toothing, retained by a jumper spring, and each abutment on the bent spring causes the toothing to pivot forward by one tooth.

Similarly, CH Patent No 671 317 in the name of GAGNEBIN discloses a push button acting on a pivoting adjustment lever, which acts against a spring, and wherein one tooth of the lever directly meshes with the moon phase wheel, which cooperates with a jumper spring.

A similar arrangement is seen in CH Patent No 4542 in the name of ABEGGLEN, wherein a first push button pivots and cooperates with a lunar wheel in a direct tooth driving arrangement. A second pivoting push button pivots a star-wheel, which is retained by a jumper spring, and cooperates with a tooth, formed by a spring comprised in a first date change wheel, in order to pivot said first date change wheel and to drive an intermediate wheel, which in turn drives a second date change wheel including a spring, which returns a pivoting, peripheral, lifting piece having the function of a click, which in turn drives a date wheel.

However, the drawback of these simple devices is that there is a risk of a sealing defect at the location of the push button used for correcting the display.

Thus, it has been envisaged to perform correction of the display by using pre-existing adjustment means found in the timepiece, in this instance the winding and time-setting stem in the case of a watch.

Thus, CH Patent No 672 223 in the name of CATENA discloses a tide and moon phase indicator, via action of the stem, in the time-setting position, in the negative direction. The mechanism includes two toothed wheels: a top wheel driven onto the hour wheel and another bottom wheel, friction mounted thereon. Each wheel drives a ring: a top ring superposed on a bottom ring, and the gear ratios in each pair comprising a toothed wheel and ring are different, so that the bottom ring rotates more slowly than the top ring, by disconnecting a friction connection on the hour wheel. Apertures on the top ring, and a suitable combination of gear ratios, allow the moon phases to be displayed in a sector of the bottom ring delimited by the top ring. The top ring always follows the hour hand, the bottom ring is retained by a click when the hour wheel is rotating in the negative direction, and it is then possible to correct the moon phase by rotating the top ring alone.

EP Patent No 0 107 177, in the name of ERARD, also discloses a moon phase display mechanism, with synchronisation via the time-setting mechanism and adjustment by turning back on the motion work. In a similar manner, the hour wheel carries a moon pinion driving an intermediate wheel which drives a moon wheel. This moon pinion itself carries a moon phase pinion, free to move and friction mounted via an annular friction spring, and said moon phase pinion drives an intermediate wheel, which drives a moon phase wheel coaxial to the moon wheel. The moon phase pinion cooperates with a click, which only allows the moon phase pinion to pivot if the hour wheel is pivoted clockwise, and otherwise blocks said wheel, which allows the moon phase to be corrected.

CH Patent 577 197, in the name of EBAUCHES SA, discloses mechanism for correcting the date via a moveable selector, controlled by the control stem via the pull out piece. This moveable selector cooperates, in some of its positions with a pivoting lever, one arm of which cooperates with the groove of the sliding pinion. This pivoting lever carries a wheel, which, when the control stem is pushed in, is arranged to cooperate with the motion work in a first lever stop position, and a star-wheel arranged to mesh with a date crown in a second lever stop position. The wheel and star-wheel are coaxial to each other. When the control stem is pulled out, this pivoting lever may also occupy an intermediate position, where the star-wheel is released from the crown and where the wheel is released from the motion work but cooperates with the beak of the pivoting selector, in a first selection position, corresponding to a pivoting movement of the stem in the clockwise direction, and in a second selection position corresponding to a pivoting movement of the stem in the anti-clockwise direction. A preferred embodiment, which combines the time-setting, calendar correction and winding functions, involves an intermediate lever, pivotally mounted on the plate, which carries the crown wheel, and which cooperates at the end of an arm comprised therein, with the pull-out piece and/or the moveable selector, which has a pin capable of being abutted against the pivoting lever carrying the wheel and the star-wheel. When the stem is in the pushed-in position, and is pivoting in the clockwise direction, the crown wheel drives the additional lever in cooperation with the moveable selector in a position where the selector has no action on the pivoting lever, which is in its intermediate position, and where the crown wheel can mesh with a barrel ratchet to wind said ratchet. When the stem pivots in the anti-clockwise direction, the crown wheel is unmeshed from the barrel ratchet and the selector is in a selection position. When the stem is pulled out from the winding position, the intermediate lever and the moveable selector occupy a position where the selector pin pushes the pivoting lever towards the first stop position thereof, causing the wheel of the pivoting lever to mesh with the motion work so as to set the time. When the stem is pulled out from the selection position, the intermediate lever and the moveable selector occupy a position which allows the pivoting lever to pivot towards the second stop position thereof under the action of the return spring, allowing the star-wheel to mesh with the date crown. However, this efficient device requires a large number of levers, and occupies space in an area which is already very overcrowded.

EP Patent No 0 230 878, in the name of COMPLICATIONS SA, offers moon phase correction using the intermediate position of the stem, between the winding and time-setting positions. In this position, the sliding pinion meshes with a lever that moves longitudinally in a hole, between a position that corresponds to a first direction of pivoting of the stem where it adjusts the date via a wheel carrying a star-wheel, and another position that corresponds to a second, opposite direction of pivoting of the stem, where it adjusts the moon phase, each time via a star-wheel. The moon phase disc is driven from an additional hour wheel, by a wheel including two elastic fingers, one of which cooperates with a star-wheel having seven teeth for the days of the week held by a jumper spring. The other finger cooperates with the toothing of the moon phase disc, which is also held by a jumper spring. These elastic fingers allow correction to be performed at any time without any damage, even if the fingers are meshed with the star-wheel.

Similarly, EP Patent No 0 479 147 in the name of ETA SA discloses a moon phase corrector using the control stem. It also includes a sliding pinion that can move in a hole in an arc of a circle, between positions for driving a date wheel or moon phase wheel, with which it cooperates via a top wheel, whereas a bottom wheel of this sliding pinion remains permanently meshed with a corrector wheel driven by the pivoting movement of the stem.

CH Patent No 651 172 in the name of WIEDERRECHT has a moon phase indicator with correction via the crown. A moon wheel with 59 teeth, held by a jumper spring, cooperates with a click, which is pivotally mounted off-centre, and can move between two flat stop sections, on an intermediate wheel whose pivot is carried by a flat spring and which meshes with a pinion driven onto the hour wheel. Once a day the click drives the moon disc, when an actuating tooth comprised in said click enters the toothing of the moon disc, and when a rear edge of the click abuts against a first flat section of the intermediate wheel, thus driving the moon wheel through one and a third teeth, so as to enable the jumper spring to jump one tooth. The lunar day is set by alternate forward and backward movements of the winding crown having an amplitude corresponding to one or two hours around midday. When the crown drives the hands in the anti-clockwise direction, the intermediate wheel pivots clockwise and, when the drive tooth of the click enters into contact with the front flank of a tooth of the moon disc, the click tips on the pivot thereof until it abuts a front edge on another flat section of the intermediate wheel. The drive tooth is then partially retracted, and, as the pivoting of the intermediate wheel continues, the moon disc is driven by one fifth of a tooth in the opposite direction, before the click escapes from the tooth of the moon disc which it was driving. The jumper spring then returns the moon disc to its former position, which means that the moon disc is driven step by step only clockwise towards the desired position. This ingenious device requires components of very small size, which are difficult to assemble and the device is quite fragile, in particular in the event of shocks.

Other types of mechanisms have been proposed for correcting the date or moon phases. Thus FR Patent No 2 862 143, in the name of MONTRES BREGUET SA, proposes the combination of a moon phase indicator having a date disc, with a ring having a double toothing. The date corrector is also used for correcting the moon phases. It has a pivoting lever, including a hole in which a star-wheel can move which, when it pivots clockwise drives the lunar wheel toothing, and when it pivots anti-clockwise remains at a distance therefrom owing to the hole.

EP Patent No 1 730 605, in the name of BLANCPAIN, presents a corrector device which is on or under horns, so as to free the crown and any other push buttons, and which includes a pivoting lever provided with a sealing gasket.

EP Patent No 1 939 699 A1, in the name of MONTRES BREGUET SA, discloses a multi-function coaxial corrector device for selecting or modifying display data by means of a single control member. A rotation of the control button causes a rack to move and the end of a lever arm to be positioned opposite a function corrector. Applications of pressure on the button activate and/or modify a selected function.

As an alternative to performing correction via the stem or push button, CH Patent No. 688 171, in the name of PATEK PHILIPPE, proposes performing correction by pivoting a moveable bezel, which carries two rotatably integral crowns, one engaging a toothed celestial wheel via a celestial disconnecting friction wheel, and the other engaging a toothed moon wheel via a moon disconnecting friction wheel, wherein both disconnecting wheels are friction mounted on a drive shaft provided with a wheel that meshes with a barrel. The toothed moon wheel includes an inner toothing cooperating with an off-centre moon phase wheel. A base plate includes two holes, in which the shafts of two intermediate celestial and moon disconnecting pinions can move. Depending upon the direction in which the moveable bezel is pivoting, these pinions can mesh one at a time with the corresponding disconnecting friction wheel. During correction, the disconnecting wheel concerned disconnects via friction on the drive shaft outside the correction phase, the corresponding intermediate disconnecting pinion is not meshed with the corresponding intermediate pinion. This construction offers an interesting alternative to known correction control means, but it requires special construction for the timepiece concerned, particular care as regards sealing, and involves high fabrication costs.

Other than correction mechanisms based on the use of the winding and time-setting stem, there exist few solutions for performing these corrections, except through the use of additional push buttons, which each time raise sealing problems and involve significant expense.

In particular, the equipment of timepieces such as chronographs requires further thought, to avoid increasing the number of control members, to guarantee sealing, in particular in deep sea diving conditions, and to keep the cost of the correction function at a reasonable level.

SUMMARY OF THE INVENTION

The invention proposes to overcome the shortcomings of the prior art, by proposing a mechanism using a pre-existing timepiece control member to perform corrections of a time related magnitude.

The invention therefore concerns a quick correction mechanism for a function display indicator for a movement or timepiece, wherein said movement or said timepiece includes, directly or indirectly mounted on a plate:

First control means for at least a first function, connected to first display means and capable of occupying a let down position or at least one wound control position.

Second control means for a second function, distinct from said first function, connected to second display means and capable of changing, under the effect of an action by a user, from a let down rest position to a wound control position for the instantaneous release of said second function, wherein at the end of said instantaneous release, said second control means is returned to said let down rest position by return means.

Said second control means is distinct from said first control means.

Display means for a third function, different from said first and second functions, formed by said indicator, which includes drive means for its driving.

The invention is characterized in that said device includes a first mobile part, which is arranged to be driven by said first control means and occupies a letting down position when said first control means occupies said let down position, or a winding position when said first control means occupies said wound position; and in that said device includes a second mobile part, which is arranged to be driven towards an actuating position, by said second control means when, at the same time, said first mobile part is in said winding position and said second control means changes from said let down position to said control position, in order to modify the position of said indicator, and said second mobile part is arranged to be held in a rest position, in which it does not exert any action on said indicator from which it is disconnected, when said first mobile part is in said letting down position or when said second control means is in said let down position, and further characterized in that said second mobile part includes a second support surface, arranged to cooperate, when said first mobile part is in said letting down position, in abutment with a first support surface comprised in said first mobile part, under the action of elastic return means which is comprised in said device and permanently abutting against a return support surface comprised in said second mobile part; and in that said elastic return means is arranged to push said second mobile part towards said first mobile part and to subject said second mobile part to a pivot torque that tends to move it away from said indicator.

According to one feature of the invention, said elastic return means is arranged to subject the second mobile part to a pivot torque that tends to move said mobile part closer to an actuator of said second control means.

The invention also concerns a timepiece movement including, mounted directly or indirectly on a plate:

First control means for at least a first function, connected to first display means and capable of occupying a let down position or at least one control position.

Second control means for a second function, distinct from said first function, connected to second display means and capable of changing, under the effect of an action by a user, from a let down rest position to a control position for the instantaneous release of said second function, wherein at the end of said instantaneous release, said second control means is returned to said let down rest position by return means.

Said second control means is distinct from said first control means.

Display means for a third function, different from said first and second functions, formed by said indicator, which includes drive means for its driving.

The timepiece also includes at least one quick correction mechanism of this type.

The timepiece is characterized in that said first control means includes a control stem for at least the time-setting, pivotally driving about a pivot, directly or indirectly fixed to said plate, a pull-out piece forming said first mobile part, and in that said let down position corresponds to a stop position for said stem, which is arranged to occupy at least one other longitudinal control position.

The invention also concerns a timepiece including at least one movement of this type, and/or one quick corrector mechanism of this type.

The invention also concerns a timepiece of this type, characterized in that it is a chronograph.

BRIEF DESCRIPTION OF THE DRAWINGS

Other features and advantages of the invention will appear upon reading the following description, with reference to the annexed Figures, in which:

FIG. 1 shows a schematic, partial view of a timepiece, which has a movement including first control means and second control means, in addition to a function display indicator, and which is capable of receiving a corrector mechanism according to the invention.

FIG. 2 shows a schematic, partial view of a timepiece which includes a movement and function display indicators, and is capable of receiving a corrector mechanism according to the invention.

FIG. 7 shows the mechanism of FIG. 3, in a wound position, similar to FIG. 5, where the corrector is active but not pressed in, corresponding to another wound position of the first control means and the let down position of the second control means.

DETAILED DESCRIPTION OF PREFERRED EMBODIMENTS

Figure 3:
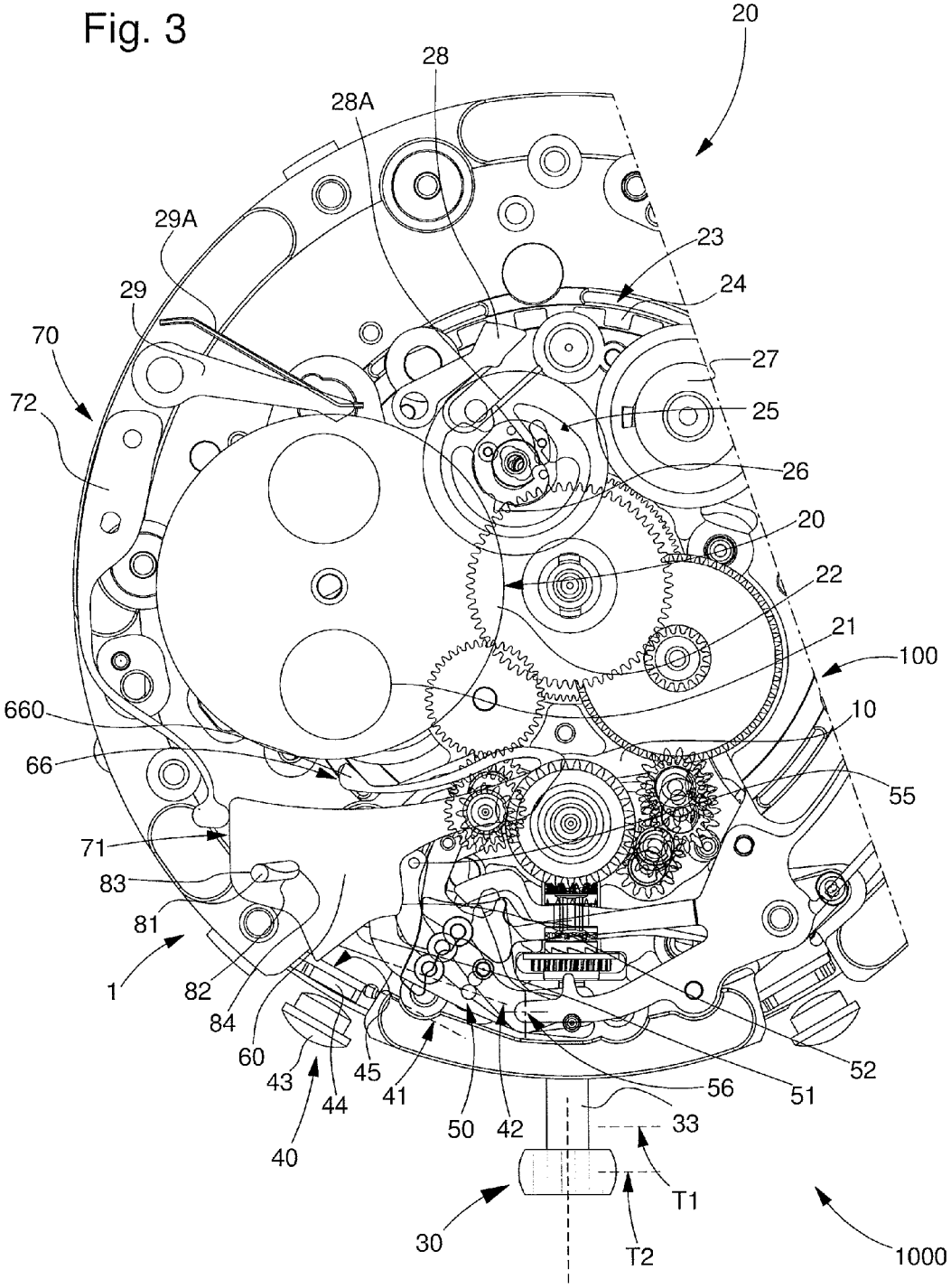
FIG. 3 shows a schematic, partial view of a timepiece which includes a movement fitted with a corrector mechanism according to the invention, in an intermediate position of transition between a let down position and a wound position.

The invention concerns the field of horology, and more specifically the field of timepiece including complications for the display of time related magnitudes, such as the date, moon phase, day, month or suchlike, or for the display of physical magnitudes, such as atmospheric pressure or other.

More specifically, the invention is described in the application to the field of chronographs fitted with these complications.

Thus, the invention concerns a quick correction mechanism 1 for a function display indicator 20 for a movement 100 or a timepiece 1000.

This movement 100 or this timepiece 1000 conventionally includes, directly or indirectly mounted on a plate 10:

First control means 30 for at least a first function, which is connected to first display means and is capable of occupying a let down position 31 or at least one wound control position 32. This first function may, in particular, consist in setting the time of the timepiece, or in winding the timepiece via the crown. In the example embodiment illustrated by the Figures, the first control means 30 includes a stem 33 for controlling at least the time-setting function, and the let down position 31 corresponds to a stop position T1 of stem 33, which is arranged to occupy at least one other wound position T2 or T3 of control 32 preferably by a longitudinal movement of the control stem, generally in traction relative to position T1, which is the pushed in position of stem 33, with the crown fitted thereto as close as possible to the timepiece case, as seen in FIG. 7.

Second control means 40 for a second function, distinct from the first function, which is connected to second display means, and is capable of changing, under the effect of an action by the user, from a let down rest position 41 to a wound control position 42 for the instantaneous release of the second function. After said instantaneous release, the second return means 40 is returned by return means to this let down rest position 41. This second control means 40 is not arranged to remain in the wound control position 42, which is only a transitory actuating position. In a preferred, but non-limiting application of the invention, illustrated by the Figures, timepiece movement 100 includes a chronograph movement, and this second function may consist of the chronograph stop/start or the chronograph reset function. In both cases, the second control means 40 includes a push-button 43 for controlling the stop/start mechanism or the reset mechanism concerned. When actuated by a pushing action by a user, this push-button 43 is generally arranged to drive a direct lever 44, which is returned to the let down rest position 41 of push-button 43, by elastic return means. If movement 100 does not have this direct lever, the quick correction mechanism 1 according to the invention includes a direct lever 44, which is returned, by elastic return means associated therewith, to the let down rest position 41 of the chronograph push-button 43.

This direct lever 44 means that push-button 43 does not have to be dedicated to a single function. The lever is preferably flag-shaped, with one wing bent at right angles relative to a plane of the lever. This wing at right angles includes here a first surface receiving the impulse from push-button 43 and an opposite surface, called the control support surface 45, the function of which is set out below. Folding this wing at right angles provides flexibility over the entire height of the push button in the case.

The second control means 40 is distinct from the first control means 30.

This movement 100 or this timepiece 1000 further includes, again directly or indirectly mounted on plate 10, display means for a third function, which is different from the first and second functions. This display means for a third function is formed by an indicator 20, which includes drive means 22 for the driving thereof, for example a toothing or suchlike. The function of mechanism 1 according to the invention is to correct or adjust the position of this indicator 20. The preferred and usual case of pivotally driving indicator 20 is described in the following description, but the invention can also be used for other types of movement of this indicator 20, for example a translation, or even a complex trajectory along a cam track or similar.

This third function may be of various types: preferably, and as described below, it may be the display of a moon phase or a date. This third function may equally well concern a time display for the tide, day of the week, month, or time zone, or the setting of an alarm, striking work, countdown mechanism, date change or for counting points in a sports match, or any usual complication in horology, or other function.

However, if, as preferred, the first, second and third functions concern the display of time related magnitudes, and conventional complications, mechanism 1 of the invention is devised to be capable of correcting or setting any type of indicator, by one or several impulses, which can correct a reference or state. Consequently, the invention can also be used to correct or set other physical quantities rather than time quantities, for example for a reference barometric pressure on an altimeter mechanism, setting a course or azimuth, calculating an arithmetic quantity by adding or subtracting a value, correcting a magnetic declination, setting a radioactivity threshold, or other magnitude.

According to the invention, mechanism 1 includes a first mobile part 50, which is arranged to be driven by the first control means 30. This first mobile part 50 occupies, either a letting down position 51 as seen in FIG. 4, when the first control means 30 occupies its let down position 31, or a winding position 52, when the first control means 30 occupies its wound position 32, as seen in FIGS. 5 and 6.

Figure 5:
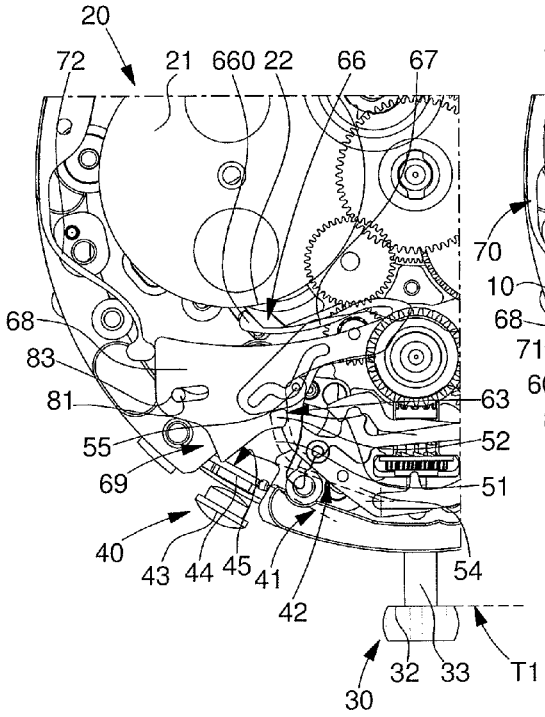
FIG. 5 shows the mechanism of FIG. 3, in a wound, position where the corrector is active but not pressed in, corresponding to the wound position of the first control means and to the let down position of the second control means.
Figure 6:
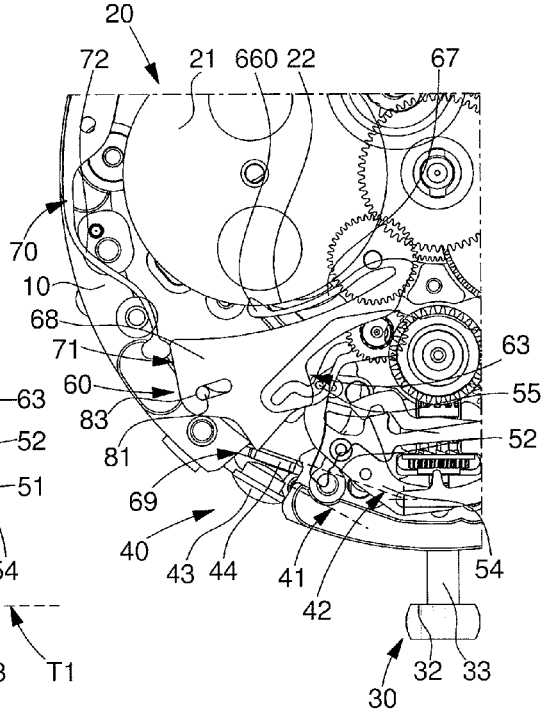
FIG. 6 shows the mechanism of FIG. 3 in a wound position where the corrector is active and pressed in, corresponding to the wound position of the first control means and to the wound position of the second control means.

According to the invention, mechanism 1 further includes a second mobile part 60, which is arranged to be driven by the second control means 40, but only when, at the same time, first mobile part 50 is in its winding position 52 as seen in FIGS. 5 and 6, and the second control means 40 changes from its let down position 41 to its control position 42, as seen in FIG. 6. Mobile part 60 is therefore driven by second control means 40 towards an actuating position to modify the position of indicator 20.

Figure 4:
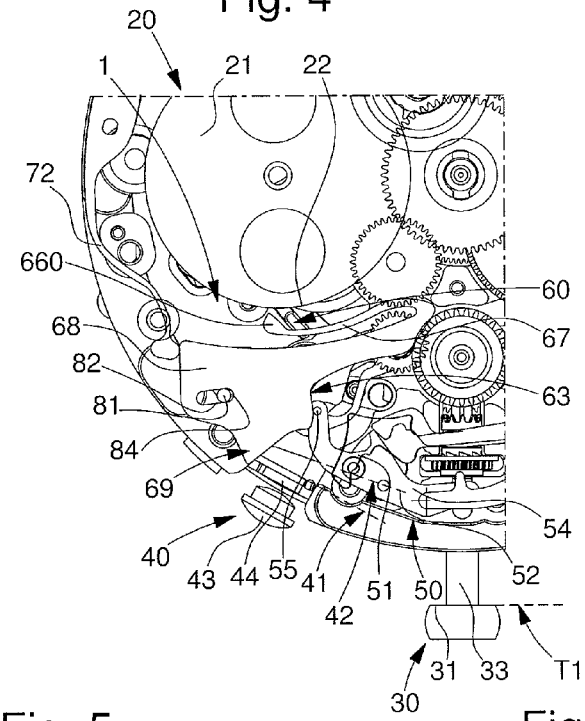
FIG. 4 shows the mechanism of FIG. 3, in a let down position where the corrector is inactive, corresponding to the let down position of the first control means and to the let down position of the second control means.

Second mobile part 60 is arranged to be held in a rest position in which it does not exert any action on indicator 20, from which it is then disconnected, when first mobile part 50 is in its letting down position 51 as seen in FIG. 4, where second mobile part 60 is occupying a let down and inactive rest position. Or second mobile part 60 is held in another rest position in which it does not exert any action on indicator 20, from which it is disconnected, when second control means 40 is in its let down position 41 shown in FIGS. 4 and 5, and where second mobile part 60 occupies a wound and inactive rest position. In the preferred embodiment of the Figures, the change from the let down and inactive rest position to the wound and inactive rest position occurs via the combination of a translation and a pivoting movement, as will be explained below.

Second mobile part 60 includes a second support surface 63, which is arranged to cooperate, when first mobile part 50 is in its letting down position 51, in abutment with a first support surface 53 comprised in first mobile part 50. This cooperation occurs under the action of elastic return means 70, comprised in mechanism 1. This elastic return means 70 is permanently supported by a return support surface 71, comprised in second mobile part 60. And this elastic return means 70 is arranged to push second mobile part 60 towards first mobile part 50, and to subject second mobile part 60 to a pivot torque which tends to move it away from indicator 20 and closer to an actuator of second control means 40, in particular, to push-button 43 and direct lever 44.

This direct lever 44 comprised, as appropriate, in mechanism 1 or second control means 40, is arranged so that the movement thereof, when a user makes a driving action, particularly by pushing on push-button 43, drives second mobile part 60 via a control support surface 45 comprised in second mobile part 60, and to form, in the let down rest position 41, a stop member limiting the pivoting movement of second mobile part 60.

Second mobile part 60 includes second guide means 64, which is arranged to cooperate with first guide means 65, which is complementary thereto, and which is arranged to be directly or indirectly secured to plate 10.

In a preferred embodiment and as seen in the Figures, the second guide means 64, respectively first complementary guide means 65, are made in the form of a hole 82, arranged to cooperate with a pin 81, forming first complementary guide means 65 or respectively second guide means 64. This pin 81 forms an instantaneous pivot pin for second mobile part 60.

Indeed, second guide means 64 or first guide means 65 preferably include stop means 83, 84 for limiting the relative travel between second guide means 64 and first guide means 65, to the value of the travel completed by second mobile part 60 between its rest position and its actuation position in which said second mobile part alters the position of indicator 20. Preferably, these stop members 83 and 84 are the ends of hole 82, which moves relative to pin 81, which is preferably fixed to plate 10. Except when first control means 30 changes position, as seen in FIG. 3, and when pin 81 is in the intermediate position between stop members 83 and 84, in every stable position of mobile part 60, pin 81 is supported by one or other of stop members 83, as seen in FIGS. 5, 6 and 7, or 84, as seen in FIG. 4.

In order to correct indicator 20 by altering the position thereof, second mobile part 60 includes complementary drive means 66, which is arranged to cooperate with the drive means 22 of indicator 20. This complementary drive means 66 is carried by a spring arm 67, which tends to apply a force to drive means 22 in a substantially radial direction. The flexibility of this spring arm 67 is useful if, for example, because of a shock or suchlike, a tooth on tooth position is reached, either between complementary drive means 66 and drive means 22, or between the latter and motor drive means comprised in movement 100 for the normal driving of indicator 20. Owing to the flexibility, the direction of any butting force does not pass through a pivot pin, or through an instantaneous pivoting centre, of indicator 20, which, because of the slight change of direction in the force, allows indicator 20 to be released.

Complementary drive means 66 imparts an impulse to drive means 22, upon each action on second control means 40, when first control means 30 is in the required position for permitting the movement thereof. This complementary drive means 66 advantageously includes at least one tooth 660, which can cooperate with a toothed wheel, a toothed sector, a rack, or even a click, forming the drive means 22 of indicator 20.

Preferably, in particular when first control means 30 includes a conventional time-setting stem, first mobile part 50 is a pull out piece 54, which is provided with a pin 55, forming a first support surface 53 arranged to cooperate with second mobile part 60. This pull out piece 54 is pivotally driven about a pivot 56 by the first control means 30, said pivot 56 being arranged to be directly or indirectly fixed to plate 10.

Preferably, according to the invention, the second mobile part 60 is a lever 68 which includes a control support surface 69, which is arranged to be driven via the support of second control means 40.

In short, the operation of the preferred variant illustrated by the Figures is as follows:

When, as shown in FIG. 4, the first control means 30 is in the let down position 31, lever 54 is in the let down position 51. Pin 55 of lever 54 then locks the second support surface 63 of lever 68, and limits the travel thereof. The return means 70, in particular formed by a spring 72, is supported by the return support surface 71 of lever 68. Pin 81 abuts against a stop member 84 at one end of hole 82 on the side of pull out piece 54. Lever 68 is then perfectly held in the rest position, and complementary drive means 66 of lever 68 is at a distance from drive means 22 of indicator 20, and cannot interfere therewith. The corrector mechanism 1 is thus let down and inactive.

When, following action on control stem 33, in particular a pulling action to change from a position 31 T1 with the crown pushed in to a pulled out T2 or T3 position 32 for setting the time via the motion work, or for winding the timepiece, the first control means 30 is in wound position 32 and lever 54 is pivoted into wound position 52. As shown in FIG. 5, pin 55 of lever 54 no longer hinders the second support surface 63 of lever 68, and allows said lever to move, under the return action of spring 72 on return support surface 71. Pin 81 is supported by stop member 83 at the other end of hole 82, on the side of spring 72. Lever 68 is pivoted clockwise by spring 72 until control support surface 69 is supported by a contact surface 45 of direct lever 44 which is in let down position 41. Mechanism 1 is then ready to operate. Complementary drive means 66 of lever 68 is moved closer to drive means 22 of indicator 20. Corrector mechanism 1 is then wound and inactive.

As seen in FIG. 6, an application of pressure on push button 43 of second control means 40 drives, preferably via this contact surface 45, the control support surface 69 of lever 68, which then pivots anti-clockwise about pin 81 and supplies an impulse, against spring arm 67 and with a greater intensity than the return force thereof and than the return torque applied by spring 72 to lever 68, to complementary drive means 66 of lever 68, which then interferes with the trajectory of drive means 22 of indicator 22 and drives said means through one step. Spring arm 67 enables tooth 660 to be released from the toothing of indicator 20, once said tooth has pivoted said toothing, without causing pivoting in the opposite direction. Mechanism 1 is then wound and active.

The return means comprised, either in second control means 40, or in mechanism 1, returns direct lever 44 towards push button 43, lever 68 is free to pivot back in the clockwise direction, and spring arm 67 facilitates the exit of complementary drive means 66 relative to drive means 22 of indicator 20, whereas spring 72 pushing face 71 of lever 68, imparts thereto a pivoting return torque in the clockwise direction about pin 81, returning lever 68 to its wound position, until control support surface 69 abuts against contact surface 45 comprised in direct lever 44, which is in the return let down position 41. At this stage, any new impulse on push button 43 will drive indicator 20 through one step.

The invention also concerns a timepiece movement 100 of this type or a timepiece 1000 of this type, which includes, directly or indirectly mounted on plate 10, at least one quick correction mechanism 1 of this type. It is clear that the same movement 100 or the same timepiece 1000 can include several quick correction mechanisms 1, each intended to correct or set a different indicator 20.

Pin 81 and pivot 56 of mechanism 1 are fixed, either directly to plate 10 of movement 100 or of timepiece 1000, or preferably, on an additional plate which is fixed to plate 10. The whole of corrector mechanism 1 is advantageously fixed to this additional plate.

In a particular construction, not illustrated here, the first control means 30 can allow a first quick corrector mechanism 1 to correct a first indicator 20, for example a moon phase indicator, in a position T2, and a second quick correction mechanism 1, to correct a second indicator 20, for example a date indicator, in another position T3. Some elements may be common to these different quick correction mechanisms 1, for example pull out piece 54, which preferably cooperates with mechanisms located on different, parallel planes. In particular, stem 33 is arranged to occupy several longitudinal control positions 32, and in each of them a mechanism 1 controls the correction of a particular indicator 20, for example, the moon in T2 and the date in T3.

Preferably, movement 100 includes a chronograph movement or mechanism, whose second control means 40 includes a control push button 43 for a chronograph reset mechanism. The chronograph movement further preferably includes limiting means to prevent the chronograph from being reset in the event of an attempt to correct indicator 20 while the chronograph is operating. The limiting means includes a moveable finger, which cooperates by butting on a spring, and allows the indicator to be corrected while preventing the chronograph from being reset, as set out in EP Patent Nos. 2 073 077 and 2 073 078 in the name of OMEGA SA.

Indeed, when the chronograph reset function is used to correct the moon phase, as set out here, the normal procedure consists in changing into the chronograph stop mode, and performing a prior reset, while the stem is in the pushed-in position T1. When the stem is pulled out into position T2 or T3, the action on reset push button 43 only corrects the moon. Another reset also takes place at the same time, since direct lever 44, which controls the reset, is driven. However, the hammer-heart piece contact is maintained and nothing happens to the chronograph. This is another reset and there is no change in the state of the chronograph. If, however, the user performs an action on push button 43 to correct the moon phase, while the chronograph is in working mode, an anti-shock mechanism, forming the above limiting means, is then released, the reset is not carried out, but direct lever 44 acts on lever 68 and the moon is corrected. The pressure force required to be exerted by the user is then greater, approximately 30 N instead of 22 N of normal force on the push button, because there is a resistant force of approximately 8 N to be overcome on the spring of the limiting means, which is wound and lets down the chronograph reset means in this case.

As described in the Figures, and preferably, indicator 22 is a moon phase indicator 21, which includes a toothed moon disc 22 with which mechanism 1 cooperates and which is held in position by a moon jumper spring 29, wound by a spring 29A. As seen in FIG. 3, a moon drive wheel 25, including a finger 26, mounted on a spring, drives the toothed moon disc 22. The spring allows this driving to be disconnected to enable correction to be performed by mechanism 1 according to the invention.

In another embodiment, indicator 20 is a date indicator 23 and mechanism 1 cooperates with a toothed date ring 24 for the pivotal driving thereof. This ring 24 is visible in FIG. 3, and is driven by a date drive wheel 27 and held in position by a date jumper spring 28, wound by a spring 28A.

The invention also concerns a timepiece 1000 including at least one movement 100 of this type, and/or at least one quick correction mechanism 1 of this type. In a particular and preferred manner, this timepiece 1000 is or includes a chronograph.

In short, the invention allows existing mechanisms to be used, for example, the pull out piece driven by the stem and the chronograph reset mechanism, with the addition of a minimal number of components, which are, furthermore, easy to make and assemble.

What is claimed is:

1. A correction mechanism for a function display indicator for a movement or a timepiece, wherein said movement or said timepiece includes, directly or indirectly mounted on a plate:

first control means for at least a first function, connected to first display means and capable of occupying a let down position or at least one wound control position;

second control means for a second function, distinct from said first function, connected to second display means and capable of changing, under the effect of an action by a user, from a let down rest position to a wound control position for the instantaneous release of said second function, wherein at the end of said instantaneous release, said second control means is returned to said let down rest position by return means;

said second control means is distinct from said first control means;

display means for a third function, different from said first and second functions, formed by said indicator, which includes drive means for the driving thereof;

wherein said correction mechanism includes a first mobile part, which is arranged to be driven by said first control means and occupies a letting down position when said first control means occupies said let down position, or a winding position when said first control means occupies said wound position; and wherein said correction mechanism includes a second mobile part, which is arranged to be driven towards an actuating position, by said second control means when, at the same time, said first mobile part is in said winding position and said second control means changes from said let down position to said control position, in order to modify the position of said indicator, and said second mobile part is arranged to be held in a rest position, in which said second control means does not exert any action on said indicator from which said second control means is disconnected, when said first mobile part is in said letting down position or when said second control means is in said let down position, and further wherein said second mobile part includes a second support surface, arranged to cooperate, when said first mobile part is in said letting down position, in abutment with a first support surface comprised in said first mobile part, under the action of elastic return means which is comprised in said correction mechanism and is permanently abutting against a return support surface comprised in said second mobile part; and wherein said elastic return means is arranged to push said second mobile part towards said first mobile part and to subject said second mobile part to a pivot torque that tends to move it away from said indicator.

2. The correction mechanism according to claim 1, wherein said elastic return means is arranged to subject the second mobile part to a pivot torque that tends to move said mobile part closer to an actuator of said second control means.

3. The correction mechanism according to claim 1, wherein said second mobile part includes second guide means, which is arranged to cooperate with first guide means, which is complementary to said second guide means, and which is arranged to be directly or indirectly secured to said plate.

4. The correction mechanism according to claim 3, wherein said first complementary guide means are made in the form of a hold arranged to cooperate with a pin forming said second guide means, said pin forming an instantaneous pivot pin for said second mobile part.

5. The correction mechanism according to claim 3, wherein said second guide means are made in the form of a hole arranged to cooperate with a pin forming said first complementary guide means, said pin forming an instantaneous pivot pin for said second mobile part.

6. The correction mechanism according to claim 3, wherein said second guide means or said first guide means include stop means for limiting the relative travel between said second guide means and said first guide means to the travel completed by said second mobile part between said rest position and said actuating position thereof in which it modifies the position of said indicator.

7. The correction mechanism according to claim 1, wherein said second mobile part includes complementary drive means arranged to cooperate with said drive means of said indicator to modify the position thereof, said complementary drive means being carried by a spring arm tending to apply a force of substantially radial direction to said drive means.

8. The correction mechanism according to claim 1, wherein said first mobile part is a pull out piece, which is provided with a pin forming a first support surface arranged to cooperate with said second mobile part, and which is pivotally driven about a pivot by said first control means, said pivot being arranged to be directly or indirectly fixed to said plate.

9. The correction mechanism according to claim 1, wherein said second mobile part is a lever, which includes a control support surface arranged to be driven by the abutment of said second control means.

10. A timepiece movement which includes at least one correction mechanism according to claim 1, wherein said first control means includes a control stem for at least the time-setting function, pivotally driving about a pivot, directly or indirectly fixed to said plate, a pull out piece forming said first mobile part, and wherein said let down position corresponds to a stop position of said stem, which is arranged to occupy at least one other longitudinal control position.

11. The timepiece movement according to claim 10, wherein said timepiece movement includes a chronograph movement, and wherein said second control means includes a push button for controlling a start/stop mechanism of said chronograph or a reset mechanism of said chronograph, said push button being arranged to drive, when actuated by a pushing action of a user, a direct lever returned to said let down rest position of said push button, by elastic return means, said direct lever being arranged such that the movement thereof during said pushing action drives said second mobile part via a control support surface comprised in said second mobile part and to form, in said let down rest position, a stop member limiting the travel of said second mobile part.

12. The timepiece movement according to claim 11, wherein said second control means includes a push button for controlling a reset mechanism of said chronograph, and wherein said chronograph movement further includes limiting means for preventing said chronograph from being reset in the event of an attempt to correct said indicator while said chronograph is operating, said limiting means including a moveable finger which cooperates by butting on a spring, and allows said indicator to be corrected while preventing said chronograph from being reset.

13. The timepiece movement according to claim 10, wherein said stem is arranged to occupy several longitudinal control positions, and wherein in each position the correction mechanism controls the correction of a particular said indicator.

14. The timepiece movement according to claim 10, wherein said indicator is a moon phase indicator, which includes a toothed moon disc with which said correction mechanism cooperates to pivotally drive said toothed moon disc.

15. The timepiece movement according to claim 10, wherein said indicator is a date indicator and wherein said mechanism cooperates with a toothed date ring for the pivotal driving thereof.

16. A timepiece including at least one correction mechanism according to claim 1.

17. The timepiece according to claim 16, wherein said timepiece is or includes a chronograph.

* * * * *